US005267826A

United States Patent [19]

Peters

[11] Patent Number: 5,267,826

[45] Date of Patent: Dec. 7, 1993

[54] SHEET HANDLING APPARATUS

[75] Inventor: Kenneth J. Peters, Dundee, Scotland

[73] Assignee: NCR Corporation, Dayton, Ohio

[21] Appl. No.: 812,599

[22] Filed: Dec. 23, 1991

[30] Foreign Application Priority Data

Feb. 14, 1991 [GB] United Kingdom ..... 9103104

[51] Int. Cl.[5] ..... B65H 31/30

[52] U.S. Cl. ..... 414/789.9; 271/199; 198/626.5

[58] Field of Search ..... 271/198-200; 198/626.5, 626.6; 414/789.9, 790.2, 709.7, 790.8

[56] References Cited

U.S. PATENT DOCUMENTS

| | | | |
|---|---|---|---|
| 2,531,253 | 11/1950 | Carden, Jr. . | |
| 3,942,785 | 3/1976 | Stange | 271/184 |
| 4,320,854 | 3/1982 | Hirose | 221/12 |
| 4,618,302 | 10/1986 | Kokubo et al. | 414/789.9 |
| 4,697,944 | 10/1987 | Peebles et al. | 198/626.6 |
| 4,750,853 | 6/1988 | Van Soest et al. | 414/789.9 |
| 4,822,018 | 4/1989 | Hain | 414/789.9 |
| 4,936,564 | 6/1990 | Hain | 271/198 |
| 4,955,964 | 9/1990 | Hain | 271/225 |
| 4,991,829 | 2/1991 | Fischer et al. | 271/199 |
| 4,997,176 | 3/1991 | Hain | 271/180 |

FOREIGN PATENT DOCUMENTS

| | | | |
|---|---|---|---|
| 1238401 | 4/1967 | Fed. Rep. of Germany | 271/198 |
| 8900 | 1/1977 | Japan | 198/626.5 |
| 2209518 | 5/1989 | United Kingdom . | |

*Primary Examiner*—Robert P. Olszewski
*Assistant Examiner*—Steven M. Reiss
*Attorney, Agent, or Firm*—Elmer Wargo

[57] ABSTRACT

A cash dispensing unit includes first and second cooperating endless belts (72, 74) for feeding a stack (76) of the currency notes to an exit port (54). End portions of the first and second belts (72, 74) respectively pass around first and second pulleys (52, 66), the first pulleys (52) having a fixed axis of rotation The second pulleys pivotally (66) are rotatably mounted on one end of pivotally mounted arms (56), and third pulleys (64) are rotatably mounted on the opposite ends of the arms (56), the third pulleys (64) being in engagement with part of the second endless belts (74) which are in cooperative engagement with the first belt (72). The first and second belts (72, 74) are resiliently stretchable and tensioned whereby the first and second pulleys (52, 66) are urged together so that when the stack (76) is positioned at the exit port (54), it is resiliently gripped between the first and second belts (72, 74).

12 Claims, 5 Drawing Sheets

SHEET HANDLING APPARATUS

BACKGROUND OF THE INVENTION

This invention relates to a sheet handling apparatus.

This invention has application, for example, to a currency note stacking and presenting mechanism included in a cash dispenser unit of an automated teller machine (ATM). As is well known, in operation of an ATM, a user inserts a customer identifying card into the machine and then enters certain data (such as codes, quantity of currency required, type of transaction, etc.) upon one or more keyboards included in a user console of the machine. The machine will then process the transaction, update the user's account to reflect the current transaction, dispense cash, when requested, from one or more currency cassettes mounted in the machine, and return the card to the user as part of a routine operation.

A cash dispenser unit of an ATM typically includes at least one note picking mechanism for extracting notes, one by one, from an associated currency cassette, and also includes a stacking and presenting mechanism for accumulating the extracted notes into a stack and then feeding the stack of notes to a delivery port or exit slot in the ATM from where the stack may be removed by a user of the ATM.

The stack feed means of a known stacking and presenting mechanism includes first and second endless belt means which are mounted in a supporting framework whereby part of the first belt means is in cooperative relationship with respect to part of the second belt means for the purpose of feeding the stack to the exit location, those portions of the first and second belt means adjacent the exit location respectively passing around cooperatively associated first and second pulley means. The axis of rotation of a first one of the pulley means is fixed relative to the supporting framework but, in order to enable stacks of different thicknesses to be accommodated between the first and second belt means, the axis of the second pulley means is movable. In said known stacking and presenting mechanism, the second pulley means are mounted on pivotably mounted support means, spring means being attached to the support means for the purpose of urging the second pulley means towards the first pulley means.

A disadvantage of the above mentioned known stacking and presenting mechanism is that the spring means tend to weaken, and possibly fail, after prolonged use, thereby detracting from the reliability of the mechanism. Another disadvantage of the known mechanism is that the gripping force applied by the belt means to the stack at the exit location tends to increase as the thickness of the stack increases, thereby detracting from the uniformity of the operational characteristics of the mechanism.

SUMMARY OF THE INVENTION

It is an object of the present invention to provide a sheet handling apparatus suitable for acting as a currency note stacking and presenting mechanism, in which the disadvantages referred to above are substantially overcome or significantly alleviated.

According to the invention there is provided a sheet handling apparatus including stacking means for accumulating sheets into a stack, and feeding means for feeding said stack to an exit location, said feeding means including first and second endless belt means which are mounted in a supporting framework whereby part of said first belt means is in cooperative relationship with respect to part of said second belt means for the purpose of feeding said stack to said exit location, those portions of said first and second belt means adjacent said exit location respectively passing around cooperatively associated first and second pulley means, said first pulley means having a first, fixed axis of rotation and said second pulley means having a second, movable axis of rotation with respect to said supporting framework, characterized in that said second pulley means are carried by support means rockably mounted about a third, fixed axis of rotation, said part of said second belt means being in cooperative engagement with third pulley means carried by said support means, and said third axis being located at an intermediate position with respect to said second and third pulley means, and said first and second belt means are resiliently stretchable and tensioned whereby said first and second belt means are resiliently gripped between said first and second pulley means, and whereby a pivotal movement of said support means takes place in response to the passage of said stack between said first and second pulley means.

It should be understood that, in operation of a sheet handling apparatus in accordance with the present invention, as a stack of sets passes from said stacking means to said exit location, the pivotal movement of the rockably mounted support means enables the thickness of said stack to be accommodated between said first and second pulley means, this pivotal movement being accompanied by a deformation of said first and second belt means.

The above objects and advantages will be more readily understood in connection with the following specification, claims and drawing.

DETAILED DESCRIPTION OF A PREFERRED EMBODIMENT

Figure 1:
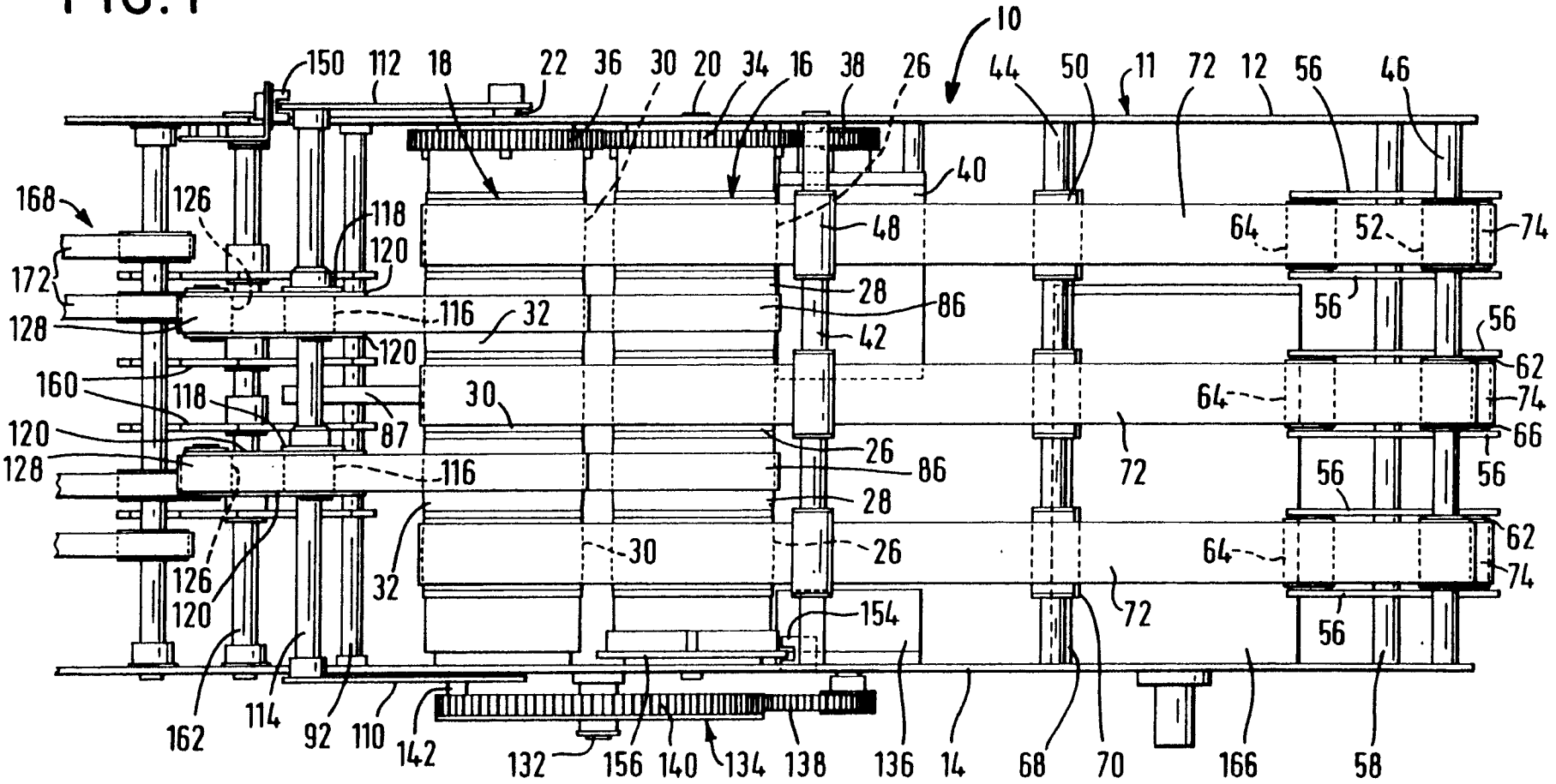
FIG. 1 is a plan view of a currency note stacking and presenting mechanism of an ATM.
Figure 2:
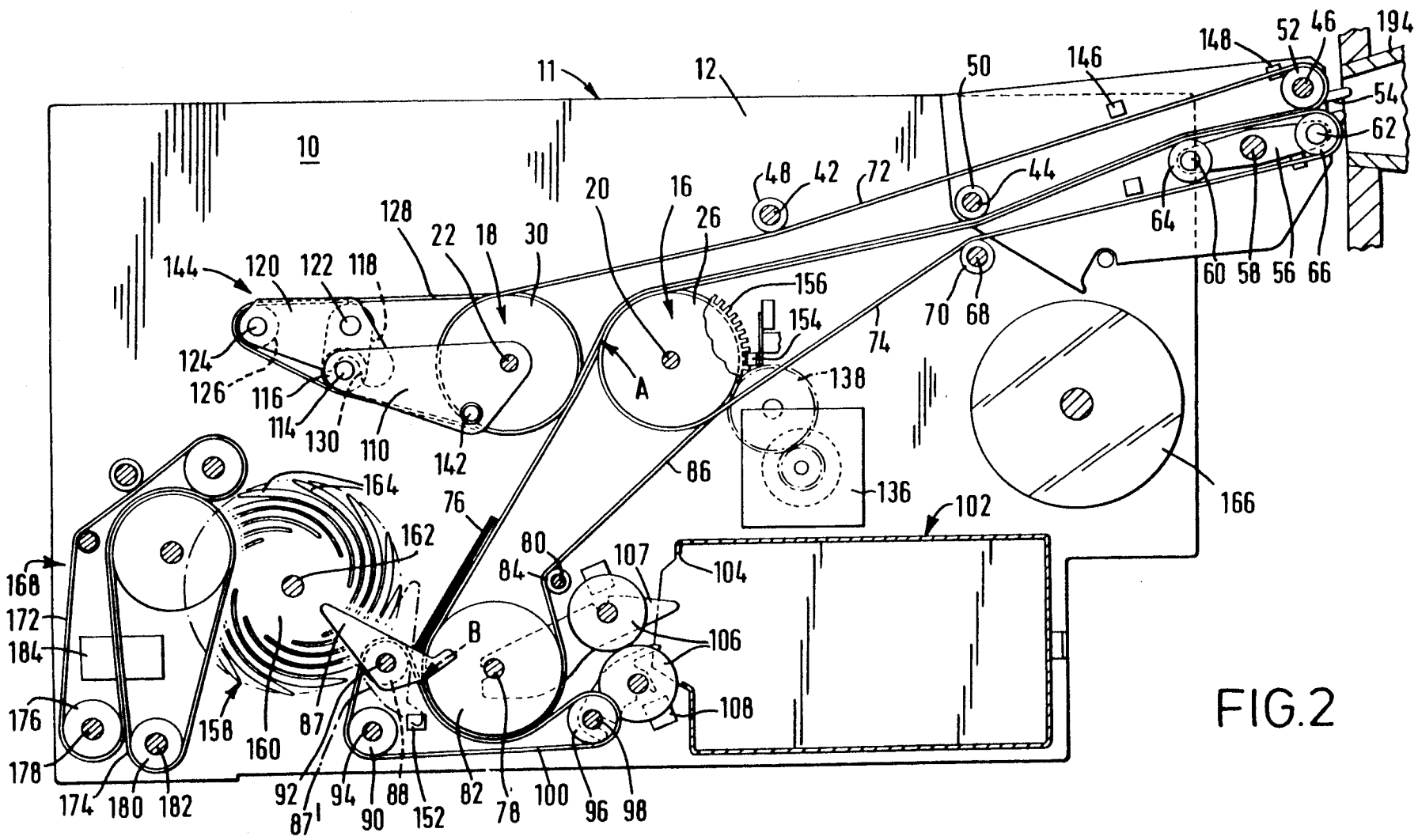
FIG. 2 is a side elevational view, shown partly in section, of the mechanism of FIG. 1, the elevational view being taken from the underside of FIG. 1, with parts of the mechanism of FIG. 1. including one of the side walls, being omitted for the sake of clarity.

Referring to FIGS. 1 and 2, the stacking and presenting mechanism 10 shown therein includes a supporting framework 11 having side walls 12 and 14. Two composite pulleys 16 and 18 are respectively rotatably mounted on two parallel shafts 20 and 22 which extend between the side walls 12 and 14, the axes of the shafts 20 and 22 lying in the same horizontal plane. The composite pulley 16 includes a first set of three operably related pulleys 26 spaced apart along the shaft 20, and two further operably related pulleys 28 which are interposed with respect to the pulleys 26 as seen in FIG. 1. Similarly, the composite pulley 18 includes three operably related pulleys 30 which are similar to, and are correspondingly located with respect to, the pulleys 26, and two further pulleys 32 which are similar to, and are corresponding located with respect to, the pulleys 28. The composite pulleys 16 and 18 are of wide diameter, having a diameter of 6.4 centimeters. Two meshing gear wheels 34 and 36 (FIG. 1) are respectively secured to the composite pulleys 16 and 18, the gear wheel 34 being coupled via a gear system 38 to a reversible electric stepping motor 40 which serves to drive the composite pulleys 16 and 18.

Three additional shafts 42, 44, and 46 extend between the side walls 12 and 14 in an upper portion of the framework 11. Three sets of pulleys 48, 50, and 52 are respectively rotatably mounted on the shafts 42, 44 and 46, each of these sets comprising three pulleys which are correspondingly located with respect to the pulleys 26 and 30. The set of pulleys 52 is located adjacent an exit port 54 (FIG. 2) of the stacking and presenting mechanism 10, and the set of pulleys 50 is located at an intermediate position with respect to the sets of pulleys 52 and 48, as shown in FIG. 2.

Figure 3:
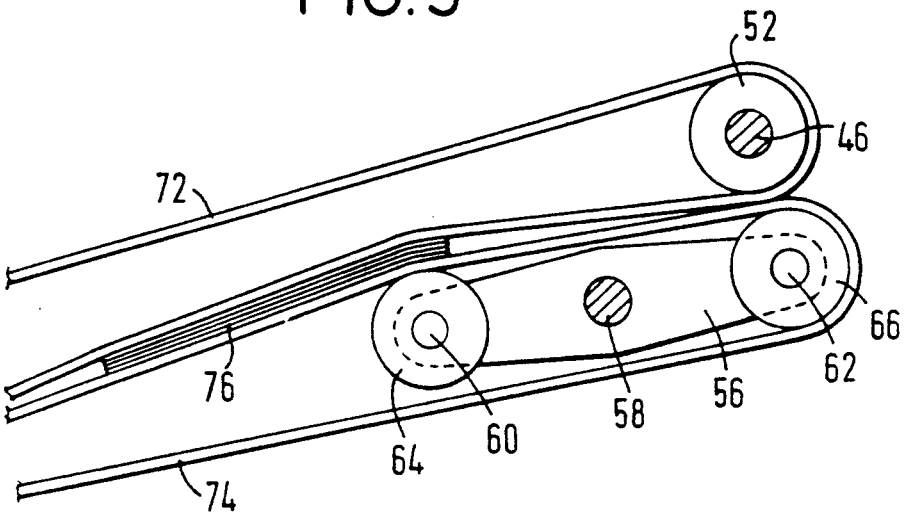
FIG. 3 is an enlarged view of part of the mechanism shown in FIG. 2, this view corresponding to one stage of a stack feeding operation.
Figure 4:
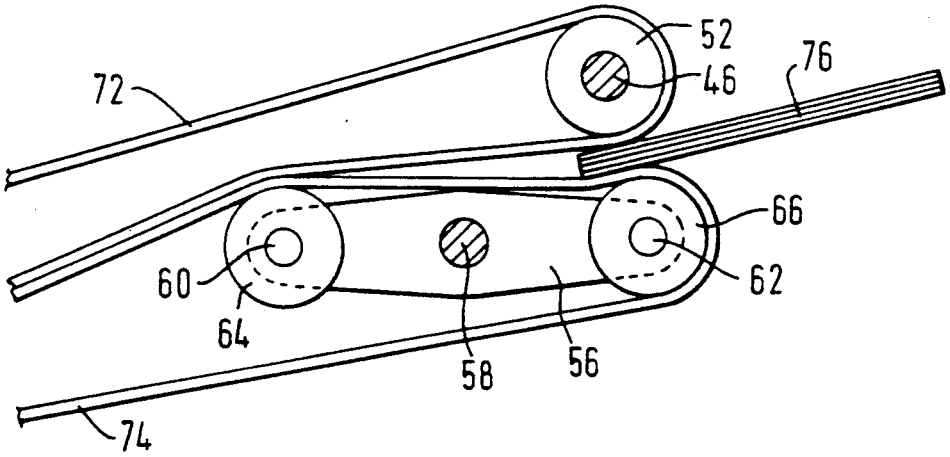
FIG. 4 is a view similar to FIG. 3 but corresponding to a later stage of a stack feeding operation.

Referring now also to FIGS. 3 and 4, three pairs of arms 56 are independently rotatably mounted on a shaft 58 which extends between the side walls 12 and 14 in a position lower than the shaft 46. One pair of corresponding ends of each pair of arms 56 carry a respective shaft 60 extending between the arms 56, and the other ends of each pair of arms 56 carry a respective shaft 62 also extending between the arms 56. Three pulleys 64 are respectively mounted on the shafts 60, and three pulleys 66 are respectively mounted on the shafts 62, the pulleys 64 and the pulleys 66 being correspondingly located with respect to the pulleys 26, 30, 48, 50, and 52. A further shaft 68 ( FIG. 2) extends between the side walls 12 and 14 and is positioned beneath the shaft 44, three further pulleys 70 being rotatably mounted on the shaft 68. The pulleys 70 are correspondingly located with respect to the pulleys 26, 30, 48, 50, 52, 64, and 66.

Three resiliently stretchable endless belts 72 pass around the pulleys 30, 50, and 52, under the pulleys 48, over the pulleys 64, and partly around the peripheries of the pulleys 26 as seen in FIG. 2, each belt 72 being cooperatively associated with a set of correspondingly located pulleys 30, 50, 52, 48, 64, and 26. Three further resiliently stretchable endless belts 74 pass around the pulleys 26, 64, and 62, under the pulleys 50 and over the pulleys 70, again as seen in FIG. 2, each belt 74 being cooperatively associated with a set of correspondingly located pulleys 26, 64, 62, 50 and 70. It should be understood that the lower parts of the belts 72, extending between the pulleys 26 and 52, are respectively in cooperative engagement with the upper parts of the belts 74 extending between the pulleys 26 and 66. The said parts of the belts 72 are held in resilient engagement with the cooperating parts of the belts 74 by virtue of these parts of the belts 72 and 74 being deflected downwardly by the pulleys 50 and upwardly by the pulleys 64, and by virtue of the belts 72 and 74 being in a slightly tensioned condition. As will be described in more detail later, in operation of the stacking and presenting mechanism 10, a stack of currency notes 76, comprising a variable number of notes, can be fed to the exit port 54 of the mechanism 10 by virtue of being gripped between the cooperating parts of the belts 72 and 74.

Located beneath the composite pulleys 16 and 18 are two shafts 78 and 80 (FIG. 2) which extend between the side walls 12 and 14. Two pairs of pulleys 82 and 84 (FIG. 2) are respectively rotatably mounted on the shafts 78 and 80, the pulleys of each pair being correspondingly located with respect to the pulleys 28 (FIG. 1) of the composite pulley 16. The pulleys 82 are of wide diameter, having a diameter of 6.4 centimeters. Two resiliently stretchable endless belts 86 pass around the pulleys 28 and 82 and partly around the peripheries of the pulleys 84, each belt 86 being cooperatively associated with a set of correspondingly located pulleys 28, 82, and 84. As shown in FIG. 2, prior to the stack of notes 76 being fed to the exit port 54, the stack 76 rests against the belts 86 with the lower long edges of the notes in the stack 76 being supported by arms 87 (hereinafter referred to as stripper arms 87).

Referring to FIG. 2, two further pairs of pulleys 88 and 90 are respectively rotatably mounted on two shafts 92 and 94 extending between the side walls 12 and 14, and another pair of pulleys 96 are secured on a drive shaft 98 extending between, and rotatably mounted with respect to, the side walls 12 and 14. The drive shaft 98 is driven by the electric motor 40 (FIG. 1) via a gear system (not shown). Two resiliently stretchable endless belts 100 pass around the pulleys 88, 90, and 96, and partially around the peripheries of the pulleys 82, each belt 100 being cooperatively associated with a set of correspondingly located pulleys 82, 88, 90, and 96. It should be understood that the upper parts of the belts 100 extending between the pulleys 88 and 96 are respectively in cooperative engagement with those parts of the belts 86 in contact with the pulleys 82. The said parts of the belts 100 are held in resilient engagement with the cooperating parts of the belts 86 by virtue of the belts 100 passing partly around the peripheries of the pulleys 82, with the belt 100 being in a slightly tensioned condition. By virtue of the resilient nature of the engagement of the belts 100 with the belts 86, a stack of rejected currency notes, comprising a variable number of notes, can be fed by the belts 100 and 86, while gripped between the cooperating parts thereof, towards a rejected note container 102 (hereinafter referred to as the purge bin 102), the rejected notes being deposited in the purge bin 102 via an opening 104 in one side thereof. After leaving the belts 86 and 100, the leading edge of the stack of rejected notes is gripped by cooperating sets of foam rubber feed rolls 106 which, together with guide means 107, serve to feed the stack into the purge bin 102. The feed rolls 106 are driven by the motor 40 (FIG. 6), and the resilient nature of the rolls 106 enables them to feed a stack of notes of variable thickness. The passage of a stack of rejected currency notes into the purge bin 102 is sensed by optical sensing means 108.

Referring to FIGS. 1 and 2, a pair of clamp arms 110 and 112 are rotatably mounted on the shaft 22. The ends of the clamp arms 110 and 112 remote from the shaft 22 carry a shaft 114 which extends between the arms 110 and 112. A pair of pulleys 116 is rotatably mounted on the shaft 114, the pulleys 116 being correspondingly located with respect to the pulleys 32 (FIG. 1) of the composite pulley 18. Two upwardly extending support arms 118 are secured on the shaft 114, and two pairs of pivotal arms 120 are respectively pivotably mounted on the two support arms 118, each pair of pivotal arms 120 being pivotably mounted on a stud 122 secured to the upper end of the respective support arm 118. Those ends of each pair of pivotal arms 120 remote from the respective support arm 118 carry a stud 124 on which is mounted a respective pulley 126, the two pulleys 126 being correspondingly located with respect to the pulleys 116 and 32. Two further resiliently stretchable endless belts 128 pass around the pulleys 126, 116, and 32, each belt 128 being cooperatively associated with a set of correspondingly located pulleys 126, 116, and 32. The belts 128 are in a slightly tensioned condition, and the lower parts of the belts 128, extending between the pulleys 126 and the pulleys 32, are deflected downwardly by the pulleys 116. By virtue of this arrangement, the pivotal arms 120 are normally resiliently held by the tension of the belts 128 in the position shown in FIG. 2, with left hand edges (with reference to FIG. 2) of two notches 130, respectively formed in the lower edges of the pivotal arms 120, bearing against the shaft 114. As will be explained in more detail later, the pivotal arms 120 may be pivoted to some extent relative to the clamp arms 110 in a clockwise direction (with reference to FIG. 2) about the axis of the studs 122, such clockwise pivotable movement being limited by engagement of the right hand edges of the notches 130 with the shaft 114.

A stud 132 (FIG. 1) is secured to the outer surface of the side wall 14, and a cam 134 (not shown in FIG. 2) is rotatably mounted on the stud 132. Two cam tracks (not shown), in the form of arcuate recesses, are formed in the inner surface of the cam 134 facing the side wall 14. The cam 134 is driven by a reversible electric stepping motor 136 via a gear system 138, the gear system 138 engaging a gear wheel 140 forming a integral part of the cam 134. A stud 142 secured to the outer face of the clamp arm 110 engages in one of the cam tracks formed in the cam 134. Normally, the clamp assembly 144 comprising the belts 128, the clamp and pivotal arms 110, 112, and 120, and the pulleys 116 and 126 is in the position shown in FIG. 2. In response to rotational movement of the cam 134 from its normal position, pivotal movement of the assembly 144 in a counterclockwise direction (with reference to FIG. 2) about the axis of the shaft 22 is brought about by virtue of the engagement of the stud 142 in the relevant cam track in the cam 134. This pivotal movement continues until the belts 128 come into cooperative relationship with the belts 86 with the stack of notes 76 gripped between the belts 128 and 86, shortly after which the rotational movement of the cam 134 is stopped in a manner to be described later. Towards the end of this pivotal movement of the assembly 144, those parts of the belts 128 passing around the pulleys 126 initially make contact with the stack 76, and thereafter, the assembly of the pivotal arms 120 and pulleys 126 undergoes a small pivotal movement in a clockwise direction relative to the clamp arms 110 and 112 about the axis 122 against the tension of the belts 128 until the cam 134 stops. It will be appreciated that, by virtue of this arrangement, a stack of notes 76 of variable thickness can be trapped between the belts 128 and the belts 86. The cooperating parts of the belts 128 and 86 extend between a location adjacent to the peripheries of the pulleys 82 and a location at which the belts 128 and 86 are in cooperative relationship with respect to the peripheries of the pulleys 32. It should be understood that when the belts 128 are in cooperative relationship with the belts 86, the pulleys 116 deflect the belts 86 slightly so that the stack of currency notes 76 resting against the belts 86 is gripped resiliently between the belts 128 and 86 by virtue of the tension in the belts 86 as well as by virtue of the tension in the belts 128. With the stack of notes 76 thus gripped between the belts 128 and 86, the stack 76 can be fed by the belts 128 and 86 to the nip A of the belts 72 and 74 from where the stack 76 is fed by the belts 72 and 74 to the exit port 54. The approach of the stack 76 to the exit port 54 is sensed first by optical sensing means 146 (FIG. 2) positioned between the pulleys 50 and the pulleys 64 and then by further optical sensing means 148 (FIG. 2) positioned adjacent the exit port 54.

Alternatively, the stack of notes 76 gripped between the belts 128 and 86 can be fed by the belts 128 and 86 to the nip B of the belts 86 and 100 from where the stack is fed by the belts 86 and 100 and the feed rolls 106 into the purge bin 102, the stripper arms 87 having first been pivoted out of the way into the position 87 shown in dashed outline in FIG. 2.

After the stack of notes 76 has been fed to the exit port 54 or to the purge bin 102, the assembly 144 is pivoted in a clockwise direction back to its home position shown in FIG. 2. The return of the assembly 144 to its home position is sensed by optical sensing means 150 (FIG. 1) which is cooperatively located with respect to the clamp arm 112. The movement of the stripper arms 87 to the position 87 is sensed by further optical sensing means 152 (FIG. 2). Another optical sensing means 154 is positioned in cooperative relationship with respect to a timing wheel 156 secured to the composite pulley 16, the sensing means 154 generating, in operation, a series of timing pulses in response to rotation of the composite pulleys 16 and 18.

All of the belts 72, 74, 86, 100, and 128 are of a resiliently stretchable elastomeric material such as polyurethane or silicone rubber.

The stacking and presenting mechanism 10 includes a conventional stacking wheel 158 which is arranged to rotate continuously in operation in a clockwise direction with reference to FIG. 2. The stacking wheel 158 comprises a plurality of stacking plates 160 spaced apart in parallel relationship along a stacking wheel shaft 162, each stacking plate 160 incorporating a series of curved tines 164. The shaft 162 extends between, and is rotatably mounted with respect to, the side walls 12 and 14, and the shaft 162 is driven via transmission means (not shown) by an electric motor 166. The stacking wheel 158 cooperates with the stripper arms 87 which are spaced apart along the shaft 92 and are secured thereto, the shaft 92 being rotatably mounted with respect to the side walls 12 and 14. Each stripper arm 87 is positioned between an adjacent pair of stacking plates 160. During a stacking operation, the stripper arms 87 are positioned as shown in solid outline in FIG. 2 with each stripper arm 87 extending into the space between adjacent stacking plates 160. In operation, currency notes are fed one by one to the stacking wheel 158 by a transport mechanism 168. Each note enters between adjacent tines 164 of the stacking plates 160 and is carried partly around the axis of the stacking wheel 158 by the stripper arms 87 and being stacked against the belts 86 with a long edge of the note being supported by the stripper arms 87. Pivotal movement of the stripper arms 87. Pivotal movement of the stripper arms 87 between their home position, shown in solid outline in FIG. 2, and the non-supporting position 87 is controlled by the cam 134 and a link mechanism (not shown), this link mechanism incorporating a stud which engages a second arcuate slot (not shown) formed in the face of the cam 134 facing the side wall 14.

The transport mechanism 168 serves to feed currency notes from a selected pick module 170 (FIG. 5) to the electric motor 166. The stacking wheel 158 cooperates with the stripper arms 87 which are spaced apart along the shaft 92 and are secured thereto, the shaft 92 being rotatably mounted with respect to the side walls 12 and 14. Each stripper arm 87 is positioned between an adjacent pair of stacking plates 160. During a stacking operation, the stripper arms 87 are positioned as shown in solid outline in FIG. 2, with each stripper arm 87 extending into the space between adjacent stacking plates 160. In operation, currency notes are fed one by one to the stacking wheel 158 by a transport mechanism 168. Each one enters between adjacent tines 164 of the stacking plates 160 and is carried partly around the axis of the stacking wheel 158, the note being stripped from the wheel 158 by the stripper arms 87 and being stacked against the belts 86 with a long edge of the note being supported by the stripper arms 87. Pivotal movement of the stripper arms 87 between their home position, shown in solid outline in FIG. 2, and the non-supporting position 871 is controlled by the cam 134 and a link mechanism (not shown), this link mechanism incorporating a stud which engages a second arcuate slot (not shown) formed in the face of the cam 134 facing the side wall 14.

The transport mechanism 168 serves to feed currency notes from a selected pick module 170 (FIG. 5) to the stacking wheel 158. The mechanism 168 includes two sets of cooperating endless belts 172 and 174. The belts 172 are driven by a set of pulleys 176 mounted on a drive shaft 178, and the belts 174 are driven by a set of pulleys 180 mounted on a drive shaft 182, the shafts 178 and 182 being driven via transmission means (not shown) by the motor 166. In operation, each currency note fed to the transport mechanism 168 is gripped between the belts 172 and 174 and is fed by the belts 172 and 174 to the stacking wheel 158 where the note is deposited between adjacent tines 164 of the stacking plates 160. A multiple note detect means 184, schematically indicated as a box in FIG. 2, is positioned part way along the cooperating parts of the belts 172 and 174 for the purpose of detecting the passage of superposed notes between the belts 172 and 174.

Figure 5:
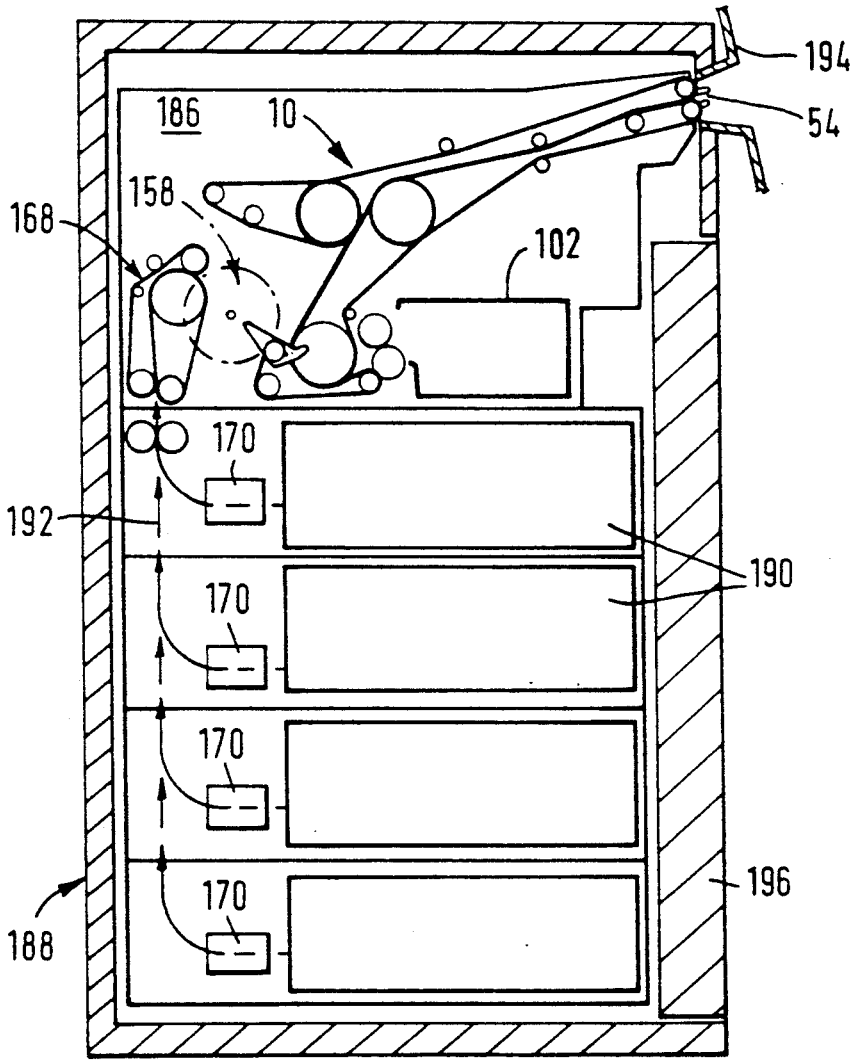
FIG. 5 is a schematic side elevational view of an ATM having a cash dispenser unit incorporating the stacking and presenting mechanism of FIGS. 1 to 4.

Referring now particularly to FIG. 5, the note stacking and presenting mechanism 10 forms part of a cash dispenser unit 186 of an in-lobby ATM. The mechanism 10 and the pick modules 170 are housed in a safe 188. Each of the pick modules 170 is arranged to pick currency notes one by one from an associated currency cassette 190, and is arranged to feed each note picked from the associated cassette 190 along a command feed path 192 to the transport mechanism 168 of the mechanism 10. Notes picked from one or more of the cassettes 190 are stacked by the mechanism 10 as previously described, and are then presented to a user of the ATM via the delivery port 54 formed in a user console 194 of the ATM. Alternatively, if a stack of notes is rejected for any reason, for example as a result of the double detect mechanism 184 detecting the passage of superposed notes, the stack is diverted to the purge bin 102. The safe 188 is provided with a door 196 via which the cassettes 190 and the bin 102 can each be removed from the safe 188 as part of the cash replenishment or bin emptying operation. The cash dispenser unit 186 includes electronic control means 198 (FIG. 6) which controls the operation of the motors 40, 136, and 166 and the pick modules 170, and to which are applied outputs of the sensor means 108, 146, 148, 150, 152 and 154 and the multiple note detect mechanism 184. It should be understood that the main drive motor 166 operates the stacking wheel 158, the drive shafts 178 and 182, and the pick modules 170.

Figure 6:
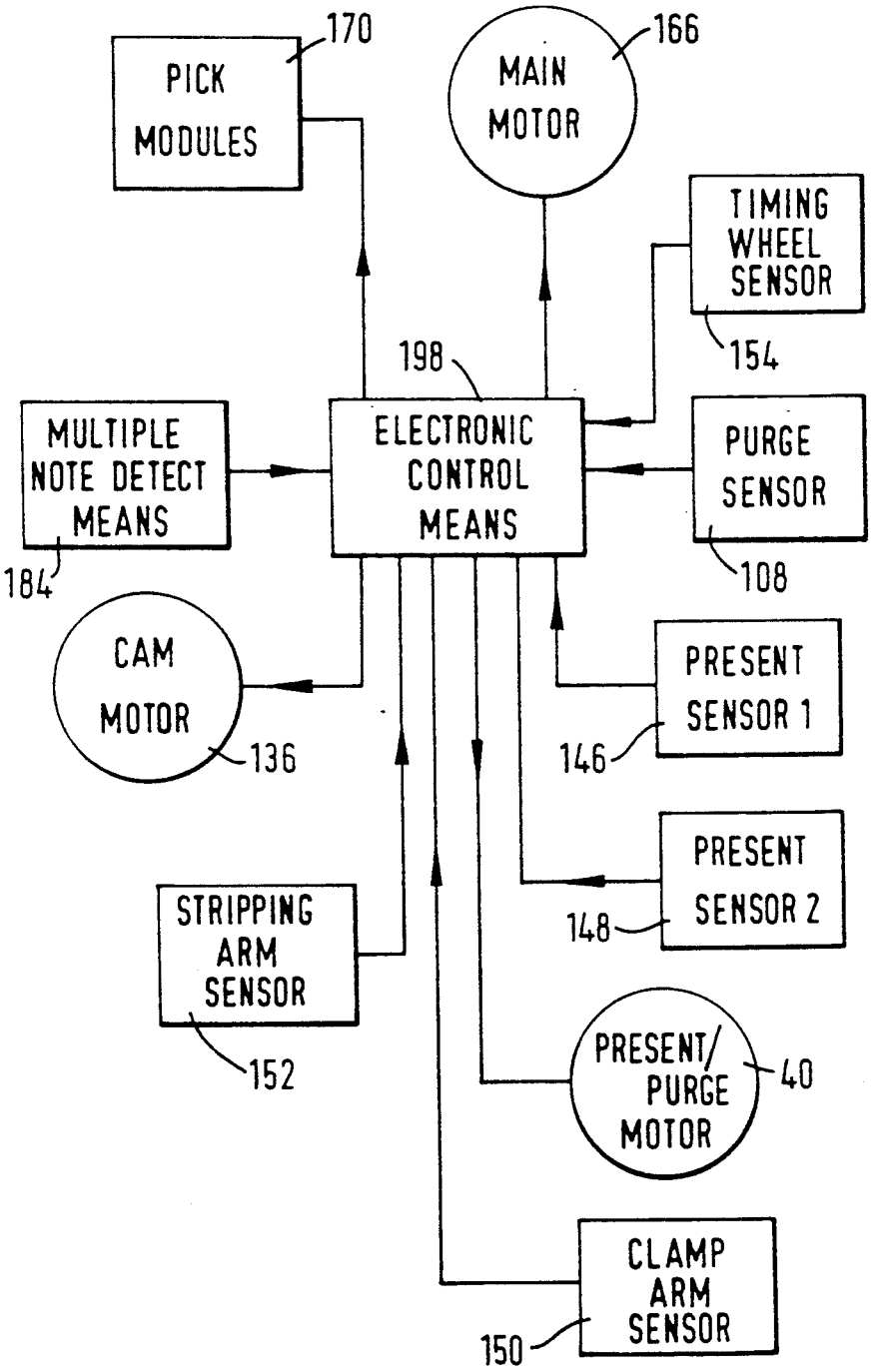
FIG. 6 is a schematic block diagram illustrating the electrical interconnections of parts of the cash dispenser unit of FIG. 5.

The operation of the cash dispenser unit 186, and particularly the operation of the stacking and presenting mechanism 10, will now be described with additional reference to FIG. 6. Immediately prior to a cash dispenser operation being initiated, the motors 40, 136, and 166 are in a deactivated condition, and the clamp assembly 144 and the stripper arms 87 are in the positions shown in solid outline in FIG. 2. A cash dispensing operation is initiated by a user inserting a customer identifying card into a card entry slot (not shown) in the user console 194 and entering appropriate data upon keyboard means (not shown) also included in the user console 194. As a result of this operation being initiated, the main drive motor 166 is activated by the control means 198 so as to operate the transport mechanism 168 and cause the stacking wheel 158 to commence rotation. Currency notes are then picked, one by one, from a selected one or selected ones of the cassettes 190 in response to the application of signals to the relevant pick module or modules 170 by the control means 198. The picked notes are fed by the transport mechanism 168 to the stacking wheel 158 which stacks the notes in known manner against the stationary belts 86 so as to form the stack 76. When the correct number of notes has been stacked against the belts 86, the control means 198 deactivates the motor 166 and sends a signal to the motor 136 to activate the motor 136 so as to rotate the cam 134 from its home position. This rotation of the cam 134 brings about a pivotal movement of the clamp assembly 144 in a counterclockwise direction with reference to FIG. 2 so as to cause the stack of notes 76 to be clamped between the belts 128 and the belts 86. At the same time, the stripper arms 87 are moved to the position $87^1$, shown in dashed outline in FIG. 2, in which the arms B7 are no longer in engagement with, nor in a path of movement of, the stack of notes 76. Shortly after the stack of notes 76 is clamped between the belts 128 and 86, the control means 198 deactivates the motor 136, so as to stop the cam 134 in response to the sensor means 152 sensing the stripping arms 87 reaching the position $87^1$.

Thereafter, the control means 198 sends a signal to the motor 40 so as to activate the motor 40 in such a sense as to cause the belts 128 and 86 to feed the stack of notes 76 to the nip A of the belts 72 and 74 from where the stack 76 is fed by the belts 72 and 74 to the exit port 54 of the ATM.

As the stack of notes 76 is fed to the exit port 54, the sensor means 146 senses first the leading edge of the stack 76 and then the trailing edge of the stack 76. A predetermined time after the trailing edge of the stack of notes is sensed by the sensor means 146, as determined by the application of timing pulses to the electronic control means 198 by the timing wheel sensor 154; the control means 198 deactivates the motor 40 so as to stop the stack 76 in a delivery position in which part of the stack projects through the exit port 54 and part of the stack 76 is held between the belts 72 and 74 as shown in FIG. 4. If the period of time which elapses between the sensing by the sensor means 146 of the leading and trailing edges of the stack 76 is excessively long and exceeds a predetermined time limit, due to the notes in the stack 76 having become spread out in an unacceptable manner, then the control means 198 causes the operation of the motor 40 to be reversed so as to cause the stack 76 to be withdrawn back into the dispenser unit 186 and deposited in the purge bin 102.

After being fed to the delivery position, the stack of notes can be readily removed from the user console 194 by the user of the ATM. The sensor means 148 senses whether or not a stack of notes is positioned at the exit port 54. If the presented stack 76 is not removed from the console 194 by the user of the ATM within a predetermined period of time, then, as with the case of a spread out stack, the electronic control means 198 causes the stack 76 to be withdrawn into the dispenser unit 186 and deposited in the purge bin 102. Shortly after the sensing of the trailing edge of the stack 76 by the sensor means 146, the control means 198 activates the motor 136 in the reverse sense so as to bring about a reverse rotation of the cam 134 and thereby cause the stripper arms 87 and the clamp assembly 144 to be returned to their home positions shown in solid outline in FIG. 2. It will be appreciated that this movement of the stripper arms 87 and clamp assembly 144 is brought about by virtue of the engagement of the stud 142 and the stud of the link mechanism (not shown) associated with the stripper arms 87, in the cam tracks (not shown) of the cam 134. Activation of the motor 136 in the reverse sense is terminated when the sensor means 150 senses the return of the clamp arm 112 to its home, non-clamping position.

Referring particularly to FIGS. 2, 3, and 4 during a present operation, as the stack of notes 76 is passing over the pulleys 64, as shown in FIG. 3, the adjacent portions of the lower parts of the belts 72, are pushed away from the cooperating portions of the belts 74, such deformation of the belts 72 being readily accomplished by virtue of the stretchable nature of the belts 72. Then, as the leading edge of the stack 76 moves between the sets of pulleys 52 and 66, the arms 56 pivot about the shaft 58 in a clockwise direction relative to the framework 11 in order to accommodate the thickness of the stack 76. This pivotal movement of the arms 56 brings about a deformation of the adjacent portions of the upper parts of the belts 74, as seen in FIG. 4, and a further deformation of the cooperating portions of the belts 72, such deformations again being readily accomplished by virtue of the stretchable nature of the belts 72 and 74. When the stack 76 is in the present position shown in FIG. 4, ready for removal by the user of the ATM, the stack 76 is gripped firmly and resiliently in this position by virtue of the tensioned belts 72 and 74 urging the arms 56 to pivot in a counterclockwise direction about the shaft 58. It should also be understood that the arms 56 are urged by the tensioned belts 72 and 74 to pivot in a counterclockwise direction in absence of a stack of notes between the belts 72 and 74, the belts 72 and 74 being resiliently gripped between the pulleys 52 and 66. The amounts by which the belts 72 and 74 are stretched as a result of the stack 76 being present between the pulleys 52 and 66 are very small compared with the lengths of the belts 72 and 74, and so the gripping force exerted on the stack 76 by the belts 72 an 74 remains substantially constant regardless of the thickness of the stack 76. Thus, the pivotally mounted pulleys 64 and 66 associated with the resiliently stretchable belts 72 and 74 provide a simple yet highly reliable and effective means for feeding and gripping a stack of notes of variable thickness at the exit port 54. Further, the tensioned and stretchable nature of the belts 72 and 74 enables a stack of notes of variable thickness to be firmly gripped between the belts 72 and 74 for the whole of the feeding distance between the nip A and the exit port 54. A stack of notes up to 6 millimeters in thickness (approximately 40 notes or more, depending on the condition of the notes) can be fed between the belts 72 and 74. It should be understood that the pulleys 26 have a diameter which is substantially greater than that of the pulleys 52 and 66 (6.4 centimeters as compared with 2.1 centimeters). By virtue of the wide diameter of the pulleys 26, no distortion of the stack occurs during the change of direction of movement of the stack as it passes partly around the peripheries of the pulleys 26.

If for any reason it is determined that the stack of notes 76 accumulated against the stationary belts 86 is to be rejected, for example as a result of the multiple note detect mechanism 184 having detected in the course of the stacking operation that two or more notes have been picked in a single pick operation, then the stack of notes 76 will be fed to the purge bin 102. First, the motor 136 is temporarily activated, as previously described, so as to move the stripper arms 87 to the position 87 and the clamp assembly 144 to the clamping position in which the stack of notes 76 is clamped between the belts 128 and 86. Next, the control means 198 activates the motor 40 in a direction to cause the belts 128 and 86 to drive the stack of notes 72 to the nip B of the belts 86 and 100, from where the stack is fed by the belts 86 and 100 and the rolls 106 into the purge being 102. As the stack of notes approaches the bin 102, the sensor means 108 senses the leading edge of the stack. Shortly after the sensor means 108 senses the leading edge of the stack, the electronic control means 198 deactivates the motor 40 and temporarily activates the motor 136 in the reverse sense of the purpose of returning the stripper arms 87 and the clamping assembly 144 to their home positions.

Again, it should be understood that by virtue of the stretchable nature of the belts 100 a stack of notes up to 6 millimeters in thickness can be fed between the belts 86 and 100. Also, by virtue of the wide diameter of the pulleys 82, no distortion of such stack of notes occurs during the change of direction of movement of the stack as it passes partly around the peripheries of the pulleys 82.

A further advantage of the stacking and presenting mechanism 10 described above is that, by virtue of the fact that a plurality of pairs of arms 56 are independently rotatably mounted on the shaft 58 and are respectively associated with a plurality of endless belts 74, the stack 76 is firmly gripped at the exit slot 54 between the belts 72 and 74, even though the thickness of the stack 76 may vary across its width (i.e. across the dimension of the stack 76 parallel to the axis of the shaft 58) due to slight variations in thickness across the width of individual notes.

What is claimed is:

1. A sheet handling apparatus including stacking means for accumulating sheets into a stack, and feeding means for feeding said stack to an exit location, said feeding means including first and second endless belt means which are mounted in a supporting framework whereby part of said first belt means is in cooperative relationship with respect to part of said second belt means for the purpose of feeding said stack to said exit location, those portion of said first and second belt means adjacent said exit location respectively passing around cooperatively associated first and second pulley means, said first pulley means having a first, fixed axis of rotation and said second pulley means having a second, movable axis of rotation with respect to said supporting framework, characterized in that said second pulley means are carried by support means rockably mounted about a third, fixed axis of rotation, said part of said second belt means being in cooperative engagement with third pulley means carried by said support means, and said third axis being located at an intermediate position with respect to said second and third pulley means, and said first and second belt means are resiliently stretchable and tensioned by said third pulley means, with said third pulley mean sand said support means being the sole means to resiliently bias said second pulley means towards said first pulley means.

2. The apparatus as claimed in claim 1, characterized in that said part of said second belt means which is in cooperative engagement with aid first belt means is deflected by said third pulley means away from a further part of said second belt means which is disposed on that side of said third pulley means remote from said first belt means.

3. The apparatus as claimed in claim 1 or claim 2, characterized in that said support means is formed by arm means on one end of which are rotatably mounted said second pulley means and on the opposite end of which are rotatably mounted said third pulley means.

4. The apparatus as claimed in claim 3, characterized in that end portions of said first and second belt means remote from said exit location respectively pass around first and second further pulley means each having a fixed axis of rotation, said second belt means being mounted on said second further pulley means and said first belt means being mounted on said first further pulley means and passing partly around the periphery of said second further pulley means.

5. The apparatus as claimed in claim 4, characterized in that said two further pulley means have substantially the same diameter and serve as drive means for said first and second belt means.

6. The apparatus as claimed in claim 5, characterized in that said further pulley means each have a diameter substantially greater than that of said first and second pulley means.

7. A sheet handling apparatus including stacking means for accumulating sheets into a stack, and feeding means for feeding said stack to an exit location, said feeding means including first and second endless belt means which are mounted in a supporting framework whereby part of said first belt means is in cooperative relationship with respect to part of said second belt means for the purpose of feeding said stack to said exit location, those portions of said first and second belt means adjacent said exit location respectively passing around cooperatively associated first and second pulley means, said first pulley means having a first, fixed axis of rotation and said second pulley means having a second, moveable axis of rotation with respect to said supporting framework, characterized in that said second pulley means are carried by support means rockably mounted about a third, fixed axis of rotation, said part of said second belt means being in cooperative engagement with third pulley means carried by said support means, and said third axis being located at an intermediate position with respect to said second and third pulley means, and said first and second belt means are resiliently stretchable and tensioned by said third pulley means, with said third pulley means and said support means being the sole means to resiliently bias said second pulley means towards said first pulley means; said part of said second belt means which is in cooperative engagement with said first belt means being deflected by said third pulley means away from a further part of said second belt means which is disposed on that side of said third pulley means remote from said first belt means; said support means being formed by arm means on one end of which are rotatably mounted said second pulley means and on the opposite end of which are rotatably mounted said third pulley means; end portions of said first and second belt means remote from said exit location respectively passing around first and second further pulley means each having a fixed axis of rotation, said second belt means being mounted on said second further pulley means and said first belt means being mounted on said first further pulley means and passing partly around the periphery of said second further pulley means; said first and second further pulley means having substantially the same diameter and serve as drive means for said first and second belt means; said first and second further pulley mean each having a diameter substantially greater than that of said first and second pulley means; and two further endless belt means for feeding said stack of sheets to said first and second belt means, said further belt means respectively passing around fifth and sixth pulley means which respectively have the same axis of rotation as said first and second further pulley means, and one of said further belt means forming part of a pivotally mounted clamp assembly, said one of said further belt means being arranged to be brought into cooperative relationship with respect to the other of said further belt means following the accumulation of said sheets into said stack by said stacking means.

8. The apparatus as claimed in claim 7, characterized by an electric motor for driving said first and second belt means, electronic control means for controlling the operation of said motor, and sensing means for sensing the passage of said stack between said first and second belt means towards said exit location, said control means being arranged to stop said motor, in response to the output of said sensing means, with a portion of said stack resiliently held between those portions of said first and second belt means passing around said first and second pulley means, and with a further portion of said stack projecting beyond said first and second belt means.

9. The apparatus as claimed in claim 8, characterized in that said electric motor is reversible, and said sensing means is arranged to sense the leading and trailing edges of said stack, said electronic control means being arranged to reverse said motor, so as to cause said first and second belt means to drive said stack towards a rejected sheet container, in the event of the time interval between the sensing of said leading and trailing edges exceeding a predetermined time limit due to the sheets making up said stack having become spread out in overlapping manner.

10. The apparatus as claimed in claim 9, characterized in that said support means together with said second and third pulley means comprises a plurality of independently mounted support and pulley assemblies spaced apart in a direction parallel to said third axis, and in that said second belt means comprise a plurality of separate endless belts respectively cooperatively associated with said support assemblies.

11. In an apparatus for dispensing a stack of sheets to an exit location, a combination comprising:

a first endless belt carried and a second endless belt carrier, with said first and second endless belt carriers being made of resiliently stretchable and tensionable material;

support structure for mounting said first and second endless belt carriers in opposed relationship to enable said stack of sheets to be moved therebetween;

said support structure including at least one fixed pulley located near said exit location for mounting said first endless belt carrier thereon and for forming a discharge end therefor;

said support structure also including a pivotal member;

said pivotal member comprising:

a member having first and second ends and having at least one first pulley rotatably mounted on said first end and at least one second pulley mounted on said second end, with said member being pivotally mounted between said first and second ends;

said second endless belt carrier being mounted on said at least one first pulley forming a discharge end opposed to the discharge end of said first endless belt carrier; and said pivotal member being located relative to said exit location to enable said at least one second pulley on said second end of said member contacting said second endless belt carrier to move said second endless belt carrier into engagement with said first endless belt carrier to bias said second endless belt carrier into engagement with said first endless belt carrier at said discharge end without the use of an additional biasing member.

12. In an apparatus for dispensing a stack of sheets to an exit location, a combination comprising:

a first endless belt carrier and a second endless belt carrier, with said first and second endless belt carriers being made of resiliently stretchable and tensionable material;

a support structure for mounting said first and second endless belt carriers in opposed relationship to enable said stack of sheets to be moved therebetween;

said support structure comprising:

a first pulley having a fixed axis of rotation, with said first endless belt being mounted on said first pulley to form a discharge end near said exit area;

a pivotal member having a pivoting axis and also having a first pulley on the second end thereof, with said pivoting axis being located between said first and second pulleys, said second endless belt carrier being mounted on said first pulley on said pivotal member to form a discharge end at said exit location;

said pivotal member being located relative to said first and second endless belt carriers to enable said second pulley on said pivotal member to stretch said first and second endless belt carriers and thereby bias said discharge end of second endless belt carrier into engagement with said discharge end of said first endless belt carrier, said second pulley on said pivotal member stretching said first and second endless belt carriers providing a sole biasing of said discharge end of said second endless belt carrier into engagement with said discharge end of said first endless belt carrier to grip said stack of sheets at the associated said discharge ends of said first and second endless belt carriers.

* * * * *

UNITED STATES PATENT AND TRADEMARK OFFICE

CERTIFICATE OF CORRECTION

PATENT NO. : 5,267,826

DATED : December 7, 1993

INVENTOR(S) : Kenneth J. Peters

It is certified that error appears in the above-identified patent and that said Letters Patent is hereby corrected as shown below:

Column 10, line 67, "portion" should be --portions--.

Column 11, line 14, "sand" should be --and--.

Column 11, line 19, "aid" should be --said--.

Column 12, line 23, "mean" should be --means--.

Column 13, line 3, "carried" should be --carrier--.

Column 14, line 16, after "on" insert --one end of said pivotal member and a second pulley on--.

Signed and Sealed this

Fourteenth Day of June, 1994

Bruce Lehman

*Attest:*

BRUCE LEHMAN

*Attesting Officer*

*Commissioner of Patents and Trademarks*